US012179964B2

(12) United States Patent
Haon et al.

(10) Patent No.: US 12,179,964 B2
(45) Date of Patent: Dec. 31, 2024

(54) PACKAGING

(71) Applicant: ROQUETTE FRERES, Lestrem (FR)

(72) Inventors: Bruno Haon, La Couture (FR); Gauthier Lemaire, Fournes en Weppe (FR); Marine Faideau, Laventie (FR); Jérôme Mugnier, L'Abergement de Cuisery (FR); Stéphane Navoret, Saint Claude (FR)

(73) Assignee: Roquette Freres, Lestrem (FR)

( * ) Notice: Subject to any disclaimer, the term of this patent is extended or adjusted under 35 U.S.C. 154(b) by 247 days.

(21) Appl. No.: 17/758,675

(22) PCT Filed: Jan. 14, 2021

(86) PCT No.: PCT/FR2021/050065
§ 371 (c)(1),
(2) Date: Jul. 12, 2022

(87) PCT Pub. No.: WO2021/144537
PCT Pub. Date: Jul. 22, 2021

(65) Prior Publication Data

US 2023/0041891 A1 Feb. 9, 2023

(30) Foreign Application Priority Data

Jan. 17, 2020 (FR) ..... 2000443

(51) Int. Cl.
*B65D 43/02* (2006.01)
*B65D 21/02* (2006.01)

(52) U.S. Cl.
CPC ..... *B65D 43/0258* (2013.01); *B65D 21/0222* (2013.01); *B65D 2543/00296* (2013.01);
(Continued)

(58) Field of Classification Search
CPC ..... B65D 2543/00685; B65D 2543/00101; B65D 21/0219; B65D 2401/25; B65D 43/0256
See application file for complete search history.

(56) References Cited

U.S. PATENT DOCUMENTS 4,966,302 A * 10/1990 Hjordie ..... B65D 45/20 220/792
5,437,386 A 8/1995 Von Holdt
(Continued)

FOREIGN PATENT DOCUMENTS

EP 0110859 A1 6/1984
EP 2523866 A1 11/2012
(Continued)

*Primary Examiner* — Jeffrey R Allen

(57) ABSTRACT

Packaging comprising, on the one hand, a plastic container having lateral walls, a top opening and a bottom, and, on the other hand, a removable plastic lid that is configured to cover the top opening in the container, wherein the container is provided, at its top opening, with a first engagement portion bearing and outward-directed rim that extends around the periphery, the lid being provided, on its peripheral part, with a second engagement portion that is folded downward and has an inward-directed rim which is able to latch underneath the outward-directed rim of the container, and wherein the second engagement portion of the lid has a skirt with foldable skirt section, the free end of which catches in a reception portion of the container.

20 Claims, 13 Drawing Sheets

(52) U.S. Cl.
CPC ..... *B65D 2543/00518* (2013.01); *B65D 2543/00537* (2013.01); *B65D 2543/00555* (2013.01); *B65D 2543/00685* (2013.01); *B65D 2543/0074* (2013.01); *B65D 2543/00805* (2013.01)

(56) References Cited

U.S. PATENT DOCUMENTS

| | | | | |
|---|---|---|---|---|
| 2006/0011631 | A1* | 1/2006 | Dengel | B65D 43/0212 220/784 |
| 2019/0168927 | A1* | 6/2019 | Tyler | B65D 25/00 |

FOREIGN PATENT DOCUMENTS

| | | | |
|---|---|---|---|
| FR | 1854484 | A | 5/2018 |
| FR | 3081449 | A1 | 11/2019 |
| WO | 2019111060 | A1 | 6/2019 |

* cited by examiner

PACKAGING

The invention relates to a packaging comprising, on the one hand, a container comprising lateral walls meeting in corners, a bottom and a top opening, as well as a lid intended to cover the top opening of the container.

TECHNICAL FIELD

The field of the invention is that of plastic packaging obtained conventionally by injection molding of the lid and of the container, and cooperating together elastically.

PRIOR ART

Known from the state of the art is packaging in which the container and the lid respectively have a first engagement portion, at the top opening of the container, and a second engagement portion, at the periphery of the lid intended to be elastically interlocked with one another.

The first engagement portion of the lid comprises an outward-directed rim that extends around the periphery, the second engagement portion of the lid being provided with an inward-directed rim, arranged on a second engagement portion skirt, which is able to latch below the outward-directed rim of the container, in order to ensure the locking of the lid onto the container.

The outward-directed rim of the container, on the one hand, and the inward-directed rim of the lid, on the other hand, have curved corner sections in the corners where said lateral walls meet, said curved corner sections connecting the lateral sections of the respective rims.

In such state of the art, the placement and locking of the lid onto the container is done by force, conventionally by means of a cylinder actuator that presses at the center of the lid in order to cause the interlocking of the first engagement portion of the container into the second engagement portion and until the inward-directed rim of the lid passes above the outward-directed rim of the container. The surfaces in mutual engagement between the two rims oppose the detachment of the lid.

The removal of the lid is typically performed by the end-user and can prove difficult for some, and may even require the aid of a tool such as a screwdriver to detach the lid from the container.

However, there is packaging in the state of the art equipped with functional parts of the lid and/or container, enabling the removal of the lid to be facilitated.

One of the solutions is disclosed in document EP 0 110 859 and consists in providing a foldable skirt section on the lid, at one of the curved corner sections of the inward-directed rim, articulated at a folding area, such as a flexible hinge, on the upper part of the second engagement portion of the lid. This foldable skirt section is able to fold from an engagement position to an outward-directed position such that a central part of said at least one curved corner section of the inward-directed rim is spaced apart by levering from the outward-directed rim of the top opening and that the engagement between the respectively inward-directed and outward-directed rims is thus weakened over the central part.

In the engagement position, the foldable skirt section is separated from the remaining skirt section by means of two grooves formed in the external surface of the skirt and extending downward from a folding area to the lower edge of the skirt, said grooves reducing the wall thickness of the skirt such that the skirt can be broken along the grooves in order to fold the foldable skirt section, from the engagement position thereof, into the outwardly directed position thereof.

Such a solution comprising a foldable skirt section greatly facilitates the opening of the lid at the location where it is most difficult (i.e., a corner), by weakening the connection between the lid and the container in this corner, and advantageously combines a tamper-evident function, the two breakable grooves being irreversibly broken after the skirt section is lifted. In document EP 0 110 859, the inwardly directed rim is borne by the foldable skirt section, located below the flexible hinge between the foldable skirt section and the second engagement portion. However, it is possible to provide the inward-directed rim above the flexible hinge as disclosed in document EP2523866, and in such a way that this rim is not severed when the foldable skirt section is lifted, and in order to preserve the seal between the lid and the container after the first opening.

One failure of such packaging, particularly during transport, for example when they are stacked on pallets, is that shocks could cause unfortunate forces beneath the foldable skirt section and result in their accidental folding. In such a case both grooves separating the skirt and the foldable skirt section are broken, indicating an opening of the packaging. In the case of transporting a high-value product, the end customer may note that the breakable grooves, which serve as tamper evidence, have been broken during transport and thus decide to refuse delivery, resulting in a significant financial loss.

The present Applicant has proposed to address this problem in document FR 1854484, by the strategic placement of exterior vertical ribs with a stacking pitch function:

thus each of said outer ribs extends vertically below the first engagement portion of the container (bearing the outward-directed rim), and has at the bottom end thereof a flat part intended to cooperate in abutment with the upper edge of the top opening of the container inside which said container is stacked:

Such vertical ribs serve firstly to ensure a constant stacking pitch between two containers when they are stacked one within the other, significantly, however, and as taught by FR 1854484, said outer ribs are advantageously positioned at the corners of the containers, each rib extending strategically from its bottom end and up to the height of said foldable skirt section when in engagement position: this position of the outer rib, vertical, in proximity to and below the foldable skirt section, indeed the ramp thus created, advantageously constitute an obstacle limiting risks of accidental opening of the foldable skirt sections in the event of accidental unfortunate pressure during uncontrolled handling, pressing beneath the skirt section until causing its folding and undesired breakage of the grooves serving as tamper evidence.

According to the findings of the present Applicant, such positioning of the outer ribs perpendicular to the foldable skirt sections makes it possible to reduce the number of accidental openings and the number of breakages of the tamperproof breakable grooves during transport and delivery. However, and even if the rate of accidental tamper evident openings is greatly diminished, it is still not zero. This involves a first problem for which the present disclosure provides a solution.

Moreover, and according to the findings of the inventors, such a tamperproof system is still not completely reliable: it is still possible to detach the lid of the container while maintaining the foldable skirt section in the engagement position thereof, that is, without having to lift and thus sever the two breakable grooves. For example, it is quite often possible to detach the lid at a corner by simultaneously pressing with one hand forcefully under the skirt section, exerting a force that tends to unlatch the lid, and with the other hand forcing the skirt section radially towards the container, thus avoiding the severing of the grooves. In this way the detachment of the lid is achieved without breaking the breakable grooves. It is also known from the state of the art, to double the latched rims at the corners with another pair of rims, respectively directed outwardly and inwardly, mutually engaging so as to latch together, arranged respectively on the first engagement portion of the container and on the second portion, in order to augment the latching at the corner. According to the findings of the inventors, providing a double pair of mutually latching rims at the corners does not always prevent tampering because it remains possible to play with the elasticity of the plastic in order to succeed in detaching the lid, still without breaking the breakable grooves. This involves a second problem for which the present disclosure offers a solution, at least according to one embodiment.

SUMMARY

The purpose of the present disclosure is to remedy the above-mentioned disadvantages by proposing a packaging comprising a lid and a container of the type described in document EP 0 110 859 or FR 1854484, which comprises a foldable skirt section facilitating the detachment of the lid, drastically reducing the number of accidental openings of the foldable skirt sections.

Another purpose of the present disclosure is to propose, at least according to one embodiment, such packaging limiting the risks of tampering, namely the detachments of the lid without breaking tamperproof breakable grooves.

Another purpose of the present invention is to propose such packaging the design of which does not complicate the injection molding equipment required for manufacturing it, and therefore its production cost.

Another purpose of the present invention is to propose such packaging for which the resistance to load during stacking of packaging is substantially improved relative to the aforementioned state of the art.

Other purposes and advantages of the invention will become apparent through the following description which is given only by way of non-limiting example.

The invention further relates to a method for manufacturing a packaging according to the invention, wherein said container and said lid are obtained by injection molding.

To that end, the present disclosure relates first of all to a packaging comprising, on the one hand, a plastic container having lateral walls meeting at corners, a top opening and a bottom, and on the other hand, a removable plastic lid that is configured to cover the top opening in the container, and wherein the container is provided at the top opening thereof with a first engagement portion bearing an outward-directed rim, and extending around the periphery, said lid being provided, on the peripheral part thereof, with a second engagement portion that is folded downward and has an inward-directed rim which is able to latch underneath the outward-directed rim of the container, and wherein the second engagement portion of the lid has a skirt extending over the lower part of the second engagement portion, and wherein the outward-directed rim of the container, on the one hand, and the inward-directed rim of the lid, on the other hand, having curved corner sections in the corners where said lateral walls meet, said curved corner sections connecting the lateral sections of the respective rims, where at least one of the curved corner sections of the inward-directed rim is provided with a foldable skirt section, articulated in a folding area at the upper part of the second engagement portion which is able to fold from an engagement position to an outward-directed position in such a way that a central part of said at least one corner section of the inward-directed rim is separated by a levering effect of the outward-directed rim of the top opening, and that the engagement between the rims is thus weakened over the central part.

According to the present disclosure the container comprises, at the foldable skirt section of the lid, a reception portion forming a shield for the free end of the foldable skirt section, with a receptacle receiving said free end in the engagement position of the foldable skirt section, said reception portion being configured to prevent the folding of said foldable skirt section to the outward-directed position, and wherein said reception portion is configured to be deformed in order to release the free end and authorize the pivoting of the foldable skirt section from the engagement position to the outward-directed position.

According to one embodiment, the receptacle comprises a front wall, extending to overlap in front of the free end of the foldable skirt section in the engagement position of the foldable skirt section, said front wall then constituting an abutment preventing the folding of said foldable skirt section to said outward-directed position, and wherein said front wall is configured to be deformed by an operator to a retracted position enabling the free end to be released and authorizing the pivoting of the foldable skirt section around the folding area from the engagement position to the outward-directed position.

According to one embodiment, the front wall is secured at its longitudinal ends by material bridges in the form of vertical ribs connecting respectively the longitudinal ends of the front wall and the lateral walls or corner of the container, and wherein a groove reducing the thickness of the front wall is provided at one of the longitudinal ends of the front wall, configured in such a way as to break by dissociating the longitudinal end of the material bridge when the front wall is deformed to the retracted position.

According to one embodiment, the front wall deformed after breakage of the groove to the retracted position and authorizing the folding of the skirt section to the outward-directed position, is still adjoining the container via the other longitudinal end.

According to one embodiment, the engagement portion of the container bearing the outward-directed rim extends and is elongated below the rim, said first rim, and is terminated below the first rim by a second rim, also outward-directed, and wherein the receptacle receiving the free end of the foldable section comprises a rear wall the upper end whereof is integral with said second rim, the rear wall being integral with the front wall via a bottom wall connecting the lower end of the rear wall and the lower end of the front wall, the section comprising the front wall, the rear wall and the bottom wall forming a U-shaped section of the receptacle receiving the free end of the foldable skirt section.

According to one embodiment, the foldable skirt section bears at least one inward-directed lug, which, in the engagement position of the foldable skirt section, is able to latch beneath the second outward-directed rim of the first engagement portion, at least when a force is applied on the lid tending to detach it, and wherein the latching of said at least one lug on the second rim is produced, in the engagement position of the foldable skirt section in a local area only along the curved corner section of the second outward-directed rim, and with a latching overlap between the mutually engaging faces of said at least one lug and of the second rim, when viewed in a direction radial to the curved section of the second rim, of larger dimension than the latching overlap between the mutually engaging faces of the inward-directed rim and of the first outward-directed rim, when viewed along a direction radial to the curved section of the first rim.

According to one embodiment, the latching of said at least one lug beneath the second rim is produced in a local area with no rear wall.

According to one embodiment, the foldable skirt section of the lid having a through-recess extending along the height of the foldable skirt section, above and perpendicular to said at least one lug.

According to one embodiment, said through-recess extends from the lower part thereof from said at least one lug and up to the folding area between the foldable skirt section and the upper part of the second engagement portion, and only over the length of the lug.

According to one embodiment, the engagement position of the foldable skirt section, and when no exterior force is applied to the lid, the latching between the inward-directed rim and the first outward-directed rim is free, while a clearance separates the second outward-directed rim and said at least one lug positioned below the second rim, said lug coming into latching contact with the second rim only when the lid is subjected to a force.

According to one embodiment, the free end of the foldable skirt section has a curved profile, along a plane parallel to the lid, and wherein the receptacle of the reception portion has, in length, a curved trajectory receiving the curved profile of the free end.

According to one embodiment, said foldable skirt section is separated from the remaining section of the skirt by means of two grooves formed in the external surface of the skirt and extending downward from a folding area to the lower edge of the skirt, said grooves reducing the wall thickness of the skirt such that the skirt can be broken along the grooves in order to fold the foldable skirt section from the engagement position thereof to the outward-directed position thereof.

According to one embodiment, the container comprises four lateral walls meeting at four corners, the inwardly directed rim of the lid having four curved corner sections with four foldable skirt sections, and four reception portions receiving respectively the free ends of the four foldable skirt sections.

According to one embodiment, the foldable skirt section bears said at least one lug, as well as the inward-directed rim, both positioned under the folding area, in the engagement position of the foldable skirt section.

According to one embodiment, the first engagement portion of the container is extended below the outward-directed rim by first snap-on means and the second engagement portion is extended below the inward-directed rim, by second snap-on means, the first snap-on means and said second snap-on means being mutually engaging at an intermediate local area along edges of the container on the lateral sections between the curved corner sections where the inward-directed rim of the lid latches the outward-directed rim of the container.

According to one embodiment, the first snap-on means comprise at least one opening, and the second snap-on means comprise an elastically deformable tooth configured to be elastically inserted into said opening, latching it.

According to one embodiment, the peripheral wall of the lid immediately extending the second engagement portion comprises, along the edges of the lid, on the lateral sections between the curved corner sections where the inward-directed rim of the lid latches the outward-directed rim of the container, counter-support ribs, projecting, vertical, positioned under the lid, oriented outwardly, forming between the curved corner sections a plurality of counter-supports on the inner faces of the lateral walls of the container, distributed around the periphery of the container, reinforcing the latching between the rims latched along the edges of the lid between the curved corner sections.

According to one embodiment, the packaging comprises wedging ribs, extending in projection around the periphery of the lid, toward the interior relative to the second engagement portion and upward relative to the horizontal wall of the lid, said wedging ribs being distributed around the inner periphery of the second engagement portion, in such a way as to receive among them the lower part of a container, while centering it, of an identical packaging stacked on the horizontal wall of the lid, said wedging ribs constituting abutments with the lower part of the lateral walls of the stacked container.

According to one embodiment, the present container has outer ribs each extending vertically below the first engagement portion, each rib having at its lower end a flat place intended to cooperate in abutment with the upper edge of the top opening of the container inside which the container is stacked, the outer ribs being provided at least partially in the corners, extending vertically below each reception portion at least up to the height of the reception portion.

The present disclosure further relates to a method for manufacturing a packaging according to the present disclosure, wherein said container and said lid are obtained by injection molding.

BRIEF DESCRIPTION OF THE DRAWINGS

Other features, details and advantages will appear from reading the following detailed description, and by analyzing the appended drawings in which.

DESCRIPTION OF EMBODIMENTS

Figure 1:
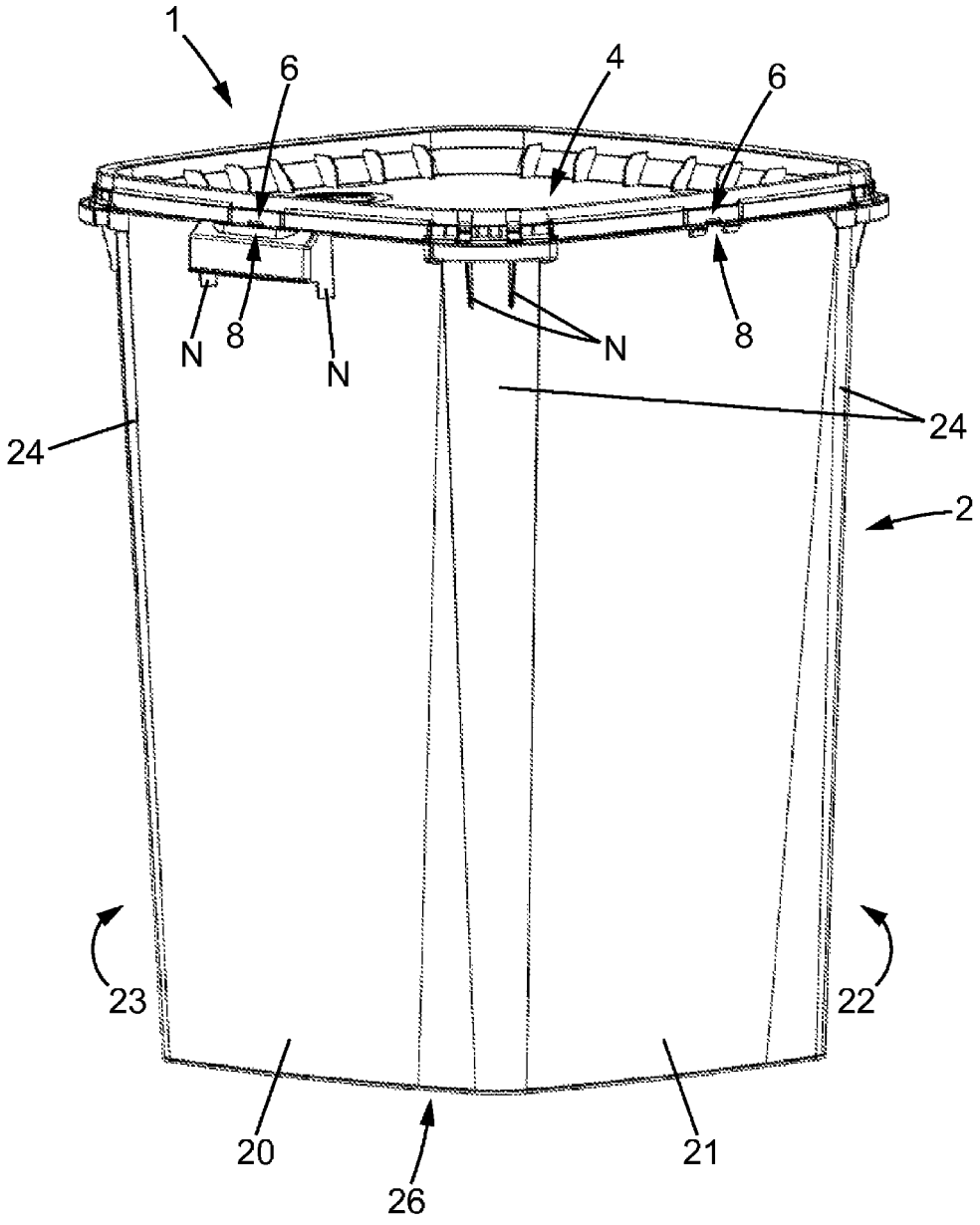
FIG. 1 is a view in perspective of a packaging according to the present disclosure, comprising a container the top opening whereof is closed by a lid of said packaging, having foldable skirt sections of the lid at the corners of the container in a position of engagement with the container, the lower ends of the foldable sections received trapped in the reception portions of the lid

The drawings and the following description substantially contain elements which are certain in nature. They therefore not only will serve for better comprehension of the present disclosure, but also contribute to the definition thereof, where applicable.

The invention relates to a packaging 1 comprising, on the one hand, a plastic container 2 comprising lateral walls 20, 21, 22, 23 meeting in corners 24, a top opening 25 and a bottom 26 and, on the other hand, a detachable plastic lid 4 configured to cover the top opening of the container.

The lateral walls 20, 21, 22, 23 may be substantially divergent, together forming a truncated pyramid, configured so that the container can be stacked inside an identical container.

The container 2 is provided, at the top opening 25 thereof, with a first engagement portion 27 bearing an outward-directed rim 28 and extending around the periphery, said lid 4 being provided around the peripheral part thereof with a second engagement portion 40 extending downward in a folded manner and provided with an inward-directed rim 41, which is able to latch below the outward-directed rim 28 of the container.

Figure 4:
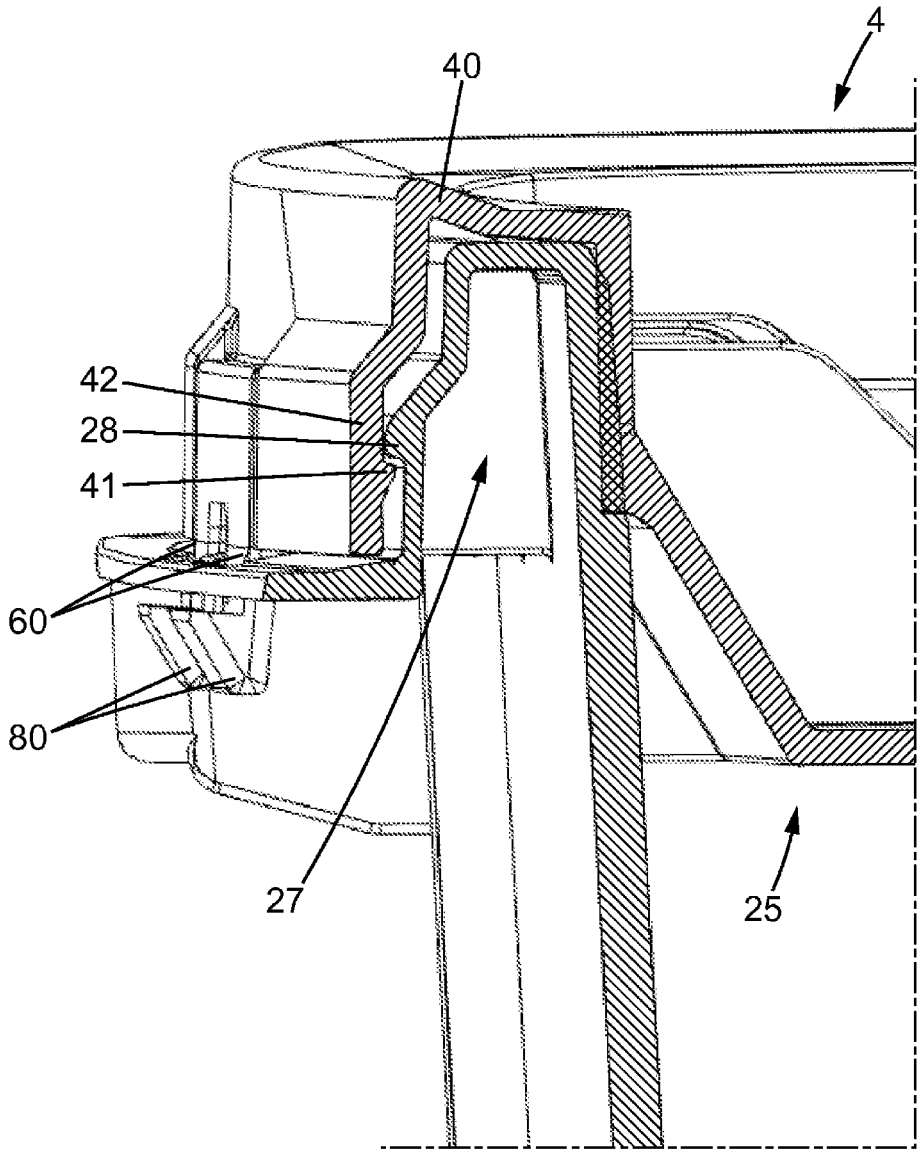
FIG. 4 is a sectional view along a vertical plane illustrating the local snap-on system, with openings and elastically deformable teeth.

Also, and in the sectional view of FIG. 4, it will be noted that the first engagement portion 27 penetrates a groove of the second engagement portion 40, open downward. The first engagement portion 27 comprises an inverted U-shaped section, including a first longitudinal section extending the inner wall upward, followed by a second longitudinal section, inclined relative to the first section, for example horizontal, followed by a third longitudinal section, inclined relative to the second section and extending downward, this third section bearing the outward-directed rim 28.

Also, and in the sectional view of FIG. 4, it will be noted that the second engagement portion 40 forms a groove open downwards, receiving the first engagement portion 27. The second engagement portion 40 comprises an inverted U-shaped section, including a first longitudinal section extending the upper wall of the lid, followed by a second longitudinal section, inclined relative to the first section, for example horizontal, followed by a third longitudinal section, inclined relative to the second section and extending downward forming a skirt 42, this third section bearing the inward-directed rim 41.

The second engagement portion of the lid thus has the skirt 42 that extends over the lower part of the second engagement portion 40, the outward-directed rim 28 of the container, on the one hand, and the inward-directed rim 41 of the lid 4, on the other hand, having curved corner sections 29, 43 in the corners where said lateral walls meet, said curved corner sections connecting the lateral sections of the respective rims.

At least one of the curved corner sections 43 of the inward-directed rim 41 is provided with a foldable skirt section 44, articulated at a folding area 46 in the upper part of the second engagement portion 40 which is able to be folded from an engagement position P1 to an outward-directed position such that a central part of said at least one curved corner section of the inward-directed rim 41 is spaced apart by levering from the outward-directed rim 28 of the upper opening, and that the engagement between the rims 28, 41 is thus weakened over the central part.

Such a foldable skirt section facilitates the detachment of the lid by the user without the need to use a tool such as a screwdriver: the weakening is achieved simply by deviating outward the foldable skirt section 44 which pivots relative to the rest of the lid around the folding area 46.

According to one embodiment, said foldable skirt section 44 is, in the engagement position thereof, separated from the remaining skirt section by means of two grooves 45 formed in the outer surface of the skirt and extending downwards from a folding area to the lower edge of the skirt: said grooves 45 reducing the wall thickness of the skirt such that the skirt can be broken along the grooves in order to fold the foldable skirt section into the outward-directed engagement position P1 thereof. These grooves 45, once irreversibly broken, constitute tamper evidence.

According to the present disclosure, the container comprises, at a foldable skirt section 44 of the lid 4, a reception portion 7 forming a shield for the free end EI of the foldable skirt section 44, with a receptacle 70 receiving said free end EI of the foldable skirt section 44 in the engagement position P1 of the foldable skirt section 44.

Such a reception portion 7 is illustrated in detail in an embodiment shown in the views of FIGS. 7 to 11.

Said reception portion 7 is advantageously configured to prevent the folding of said foldable skirt section 44 to said outward-directed position when said free end EI of the foldable section catches in the receptacle 70. During transport of the packaging, and even in the event of shocks and inappropriate forces at the curved corner of sections due to transport, the reception portion is a shield that hinders the inappropriate force from inadvertently folding the skirt section outward, and thus breaking the optional grooves 45 serving as tamper evidence.

Moreover, said reception portion 7 is configured to be deformed by an operator for releasing the free end and authorizing the pivoting of the foldable skirt section 44 from the engagement position P1 to said outward-directed position.

Thus, and to allow the removal of the lid, the operator first deforms the reception portion 7 in order to free the possibility of pivoting the foldable skirt section 44 around the folding area 46, then fold the foldable skirt section from the engagement position P1 to an outward-directed position that enables the connection at said corner to be weakened. In the case of several foldable sections at different corners of the container, the operator successively carries out these two operations for each corner 24.

Figure 8:
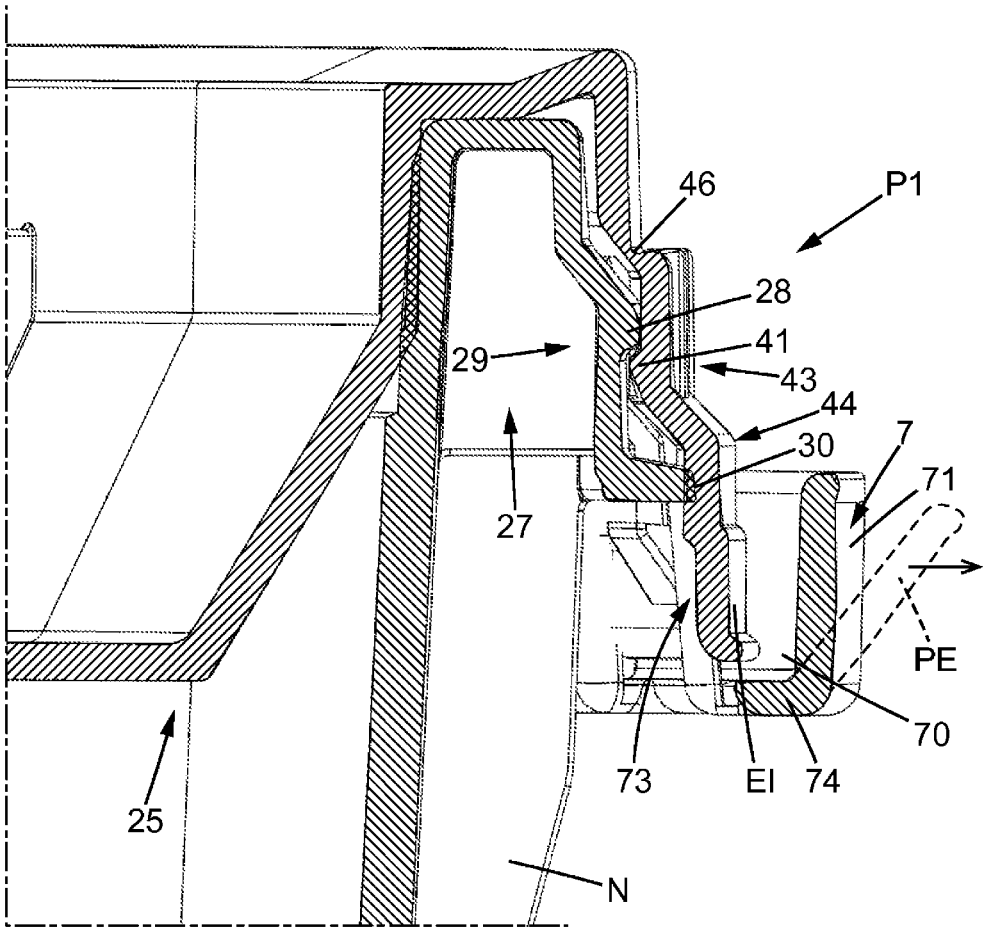
FIG. 8 is a section view along a vertical plane passing through the first engagement portion and the second engagement portion mutually engaged, and more particularly through the foldable skirt section while in engagement position, the free end of the skirt section trapped in a U-shaped receptacle, comprises a front wall extending to overlap the skirt section in front of the foldable skirt section, a rear wall, extending behind the foldable skirt section, and a bottom wall connecting the lower end of the rear wall and the lower end of the front wall, FIG. 8 illustrating in dotted lines the way the front wall is deformed to release the folding of the foldable skirt section, and thus enable the opening of the lid.

As can be seen for example in FIG. 8, and in general, the receptacle may comprise a front wall 71 extending to overlap, in front of the free end of the foldable skirt section 44 in the engagement position P1, the free end of the foldable skirt section 44 then positioned between the corner 24 and said front wall 71, said front wall 71 then forming an abutment preventing the folding of said foldable skirt section 44 to said outward-directed position.

Said front wall 71 is configured to be deformed by an operator to a retracted position PE, illustrated in dotted lines in FIG. 8, enabling the free end to be released and authorizing the pivoting of the foldable skirt section 44 from the engagement position P1 to said outward-directed position The front wall 71 may be secured at the longitudinal ends thereof via material bridges 75 connecting respectively the longitudinal ends of the front wall 71 and the lateral walls or corner of the container. These material bridges 75 may take the form of vertical ribs.

A groove 72 reducing the thickness of the front wall 71 may be provided at one of the longitudinal ends of the front wall 71 configured so as to break by disengaging the longitudinal end of the material bridge when the front wall 71 is deformed to the retracted position PE.

Once deformed in the retracted position PE, the groove 72 is broken, but preferably the front wall 71 is still adjacent to the body of the container, for example by the other longitudinal end of the front wall 71, and/or via sections of the bottom wall 24.

According to one advantageous embodiment, and as can be understood from FIG. 9, the engagement portion 27 of the container bearing the outward-directed rim 28 extends and is elongated below said rim, referred to as first rim, and ends below said first rim in a second rim 30, also outward-directed.

The receptacle 70 receiving the free end of the foldable skirt section 44 may comprise a rear wall 73 the upper end whereof is integral with said second rim 30, the rear wall 73 being integral with the front wall 71 via a bottom wall 74 connecting the lower end of the rear wall 73 and the lower end of the front wall 71.

As can be seen in FIG. 8, the section comprising the front wall 71, the rear wall 73 and the bottom wall 74 forms a U-shaped section of the receptacle 70 receiving the free end EI of the foldable skirt section 44 in the engagement position P1.

As can be seen in the figures, the free end of the foldable skirt section 44 may have a curved profile, along a plane parallel to the lid. The receptacle 70 of the reception portion 7 has, in length, a curved trajectory receiving the curved profile of the free end of the foldable skirt section 44.

The reception portion 7 according to one advantageous embodiment extends over the full length of the free end of the foldable skirt section 44. Said reception portion 7 then forms a shield hindering an undesired force, advantageously over the full length of the free end of the foldable skirt section 44.

According to the invention and in a remarkable manner, and when the first engagement portion 27 of the container bearing the outward-directed rim 28 extends and is elongated below the rim, and ends below the first rim in a second rim 41, said foldable skirt section 42 may bear at least one lug 47.

Said at least one lug 47 is directed inward. In the engagement position P1 of the foldable skirt section 4, said at least one lug 47 is able to latch beneath the second outward-directed rim 30 of the first engagement portion, at least when force is applied to the lid tending to detach it.

Notably, the latching of said at least one lug 47 on the second rim 30 is achieved, in the engagement position P1 of the foldable skirt section in only one local area, along the curved section of the second outward-directed rim 30; the lug 47 extends along the length of the second rim 30 only over a part of the second rim 30: for example the lug extends along the second rim along a dimension less than ⅓, even ⅕ of the length of the second rim 30 on the curved corner section.

Notably, the latching overlap Rac2 between the mutually engaging faces of said at least one lug 47 and the second rim 30, along a direction radial to the curved section of the second rim 30, is larger in size than the latching overlap Rac1 between the mutually engaging faces of the inward-directed rim 41 and of the first outward-directed rim 28, along a direction radial to the curved section of the first rim 28.

Figure 9:
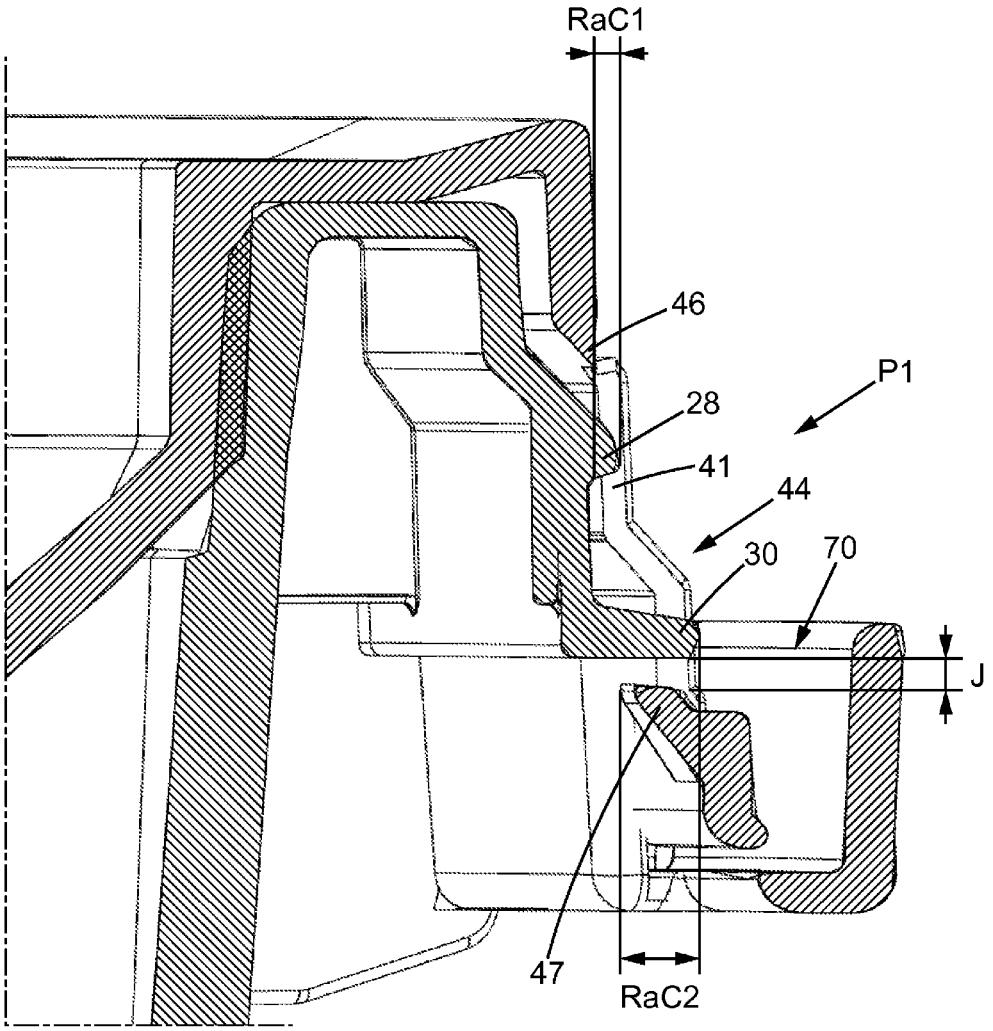
FIG. 9 is a section view along a plane slightly offset from the one of FIG. 8, passing through an area of the reception part, in which the receptacle locally has no rear wall, a lug of the foldable skirt section positioned below the inward-directed rim, overlapping below a second rim of the first engagement portion, positioned below the outward-directed rim, and according to a latching overlap between the lug and the second rim above the one between respectively the outward-directed rim and the inward-directed rim.
Figure 10:
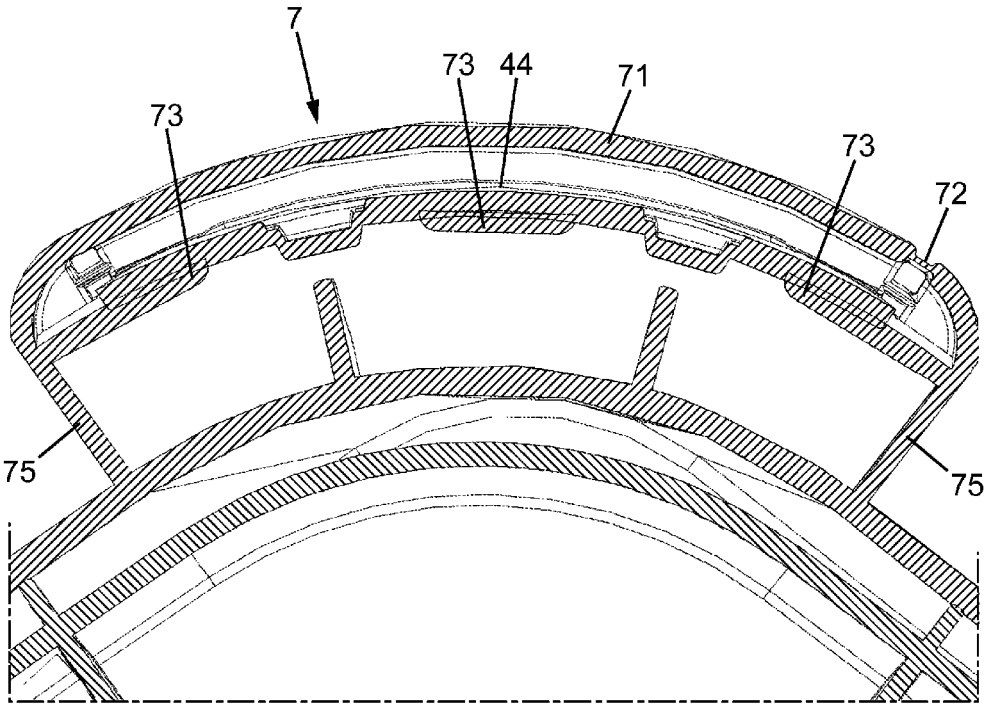
FIG. 10 is a section view along a horizontal plane illustrating the end of the foldable skirt section, of curved trajectory along the horizontal plane, trapped in the receptacle, between the front wall that extends continuously in front of the free end of the foldable skirt section and the rear wall which extends discontinuously behind the foldable skirt section.

The latching overlaps Rac2 and Rac1 can be seen for illustrative purposes in FIG. 9; it will be noted that the latching overlap Rac2 between the lug 47 and the second rim 30 is significantly larger than the latching overlap Rac1 between the inward-directed rim 41 and the outward-directed rim 28.

Also, and in the event of attempted tampering, and even assuming that the inward-directed rim 41 is released from the first rim 28 due to the weaker latching overlap Rac1, said at least one lug 47 will still latch the second rim 30 due to a larger latching overlap Rac2; by way of example, the latching overlap Rac2 between said at least one lug 47 and the second rim 30 is at least twice as large as the latching overlap Rac1 between the inwardly directed rim 41 and the first outward-directed rim 28.

Thus, it only becomes possible to unlatch said at least one lug 47 from the second rim 30 by folding the foldable skirt section 44 and advantageously by a displacement amplitude requiring the breakage of the grooves 45. Thus, the reliability of this tamper-evident system is substantially increased.

In this regard, it will be noted that the size of the inward-directed lug 47 is significantly greater than the size of the inward-directed rim 41. In this regard, the foldable skirt 42 section of the lid 4 may have a through-recess 48 extending along the height of the foldable skirt section 44, above and perpendicular to said at least one lug 47. The function of this recess is to facilitate release of the lid from the mold after injection molding during the manufacture thereof: otherwise, the large size of the lug towards the interior, necessary for obtaining the latching overlap Rac2, makes the release from the mold cumbersome, even impossible without special arrangement of the mold.

It will be noted that this through-recess 48 inherently makes the foldable skirt section 44 fragile: also, this recess extends only over the area necessary to facilitate the release from the mold, that is to say, that this recess is located perpendicular to said at least one lug 47, which itself extends over a small longitudinal section along the corner section 43, and in order to limit the size of this recess. In the end, a compromise is obtained between the facility of implementation during the injection molding manufacturing method, and the strength of the latching between the foldable skirt section and the container in that corner.

Figure 7:
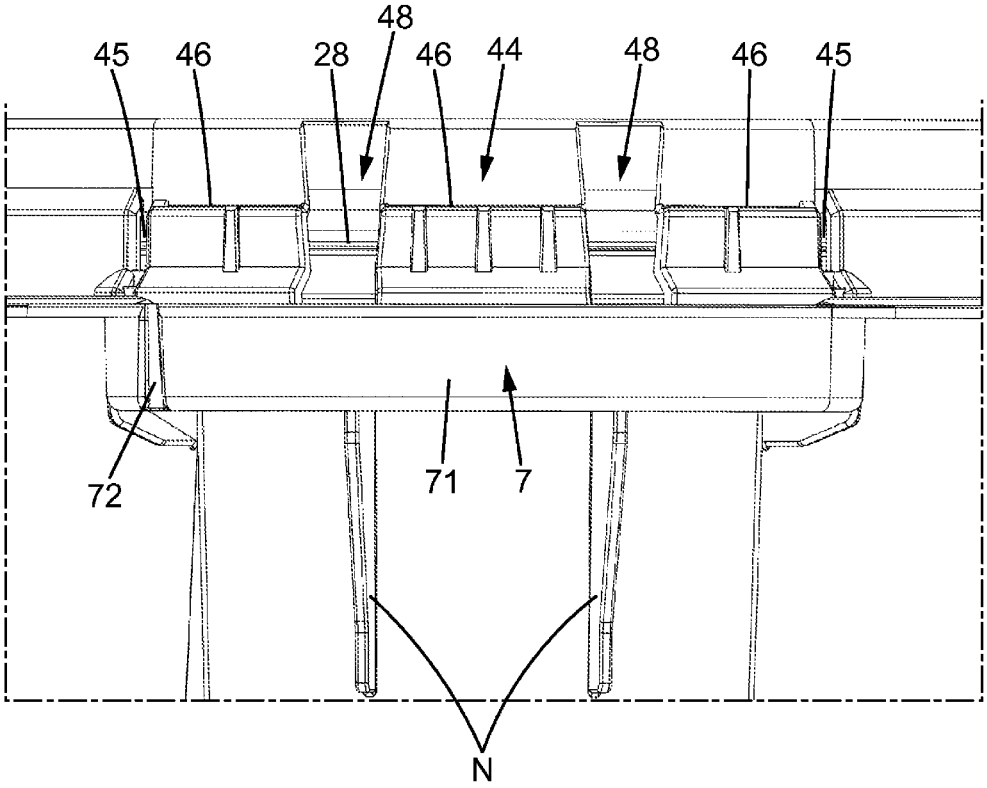
FIG. 7 is a detailed view in perspective of the foldable skirt section in the engagement position thereof, and for which the free end of the skirt section received in a receptacle of a receiving portion integral with the container and forming a shield against accidental folding of the foldable skirt section

As shown in FIG. 7, said through-recess 48, extends for example starting from the lower part thereof from said at least one lug 47 and up to the folding area 46 between the foldable skirt section 44 and the upper part of the second engagement portion 40, and only over the length of the lug 47.

In the engagement position P1 of the foldable skirt section, and when no external force is applied to the lid as shown in FIG. 9, the latching between the inward-directed rim 41 and the first outward-directed rim 28 is open, while a clearance J may separate the second outward-directed rim 30 and said at least one lug 47 positioned under the second rim 30; in such a case, said lug 47 comes into latching contact with the second rim 30 only when the lid 4 is subjected to a force, for example a force tending to detach the lid, or when there is a significant load on the lid, such as for example when the packaging according to the invention are stacked one upon the other.

Figure 11:
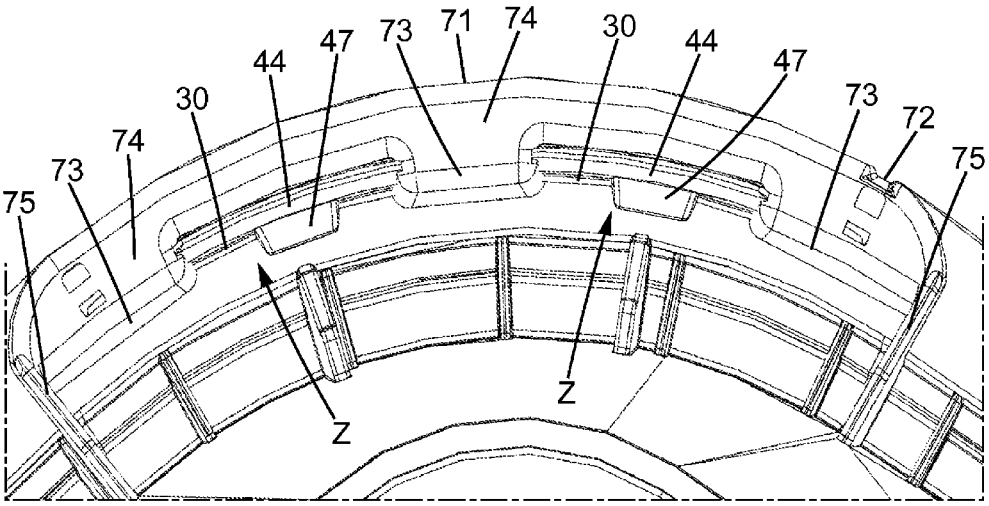
FIG. 11 is a bottom view of the reception portion of FIG. 7, illustrating the bottom wall of the receptacle, the front wall, and the rear wall which extends discontinuously, and leaving openings enabling two lugs of the foldable skirt section to serve as latching overlap with a second rim of the first engagement portion of the container

It will be noted that the latching of said at least one lug 47 under the second rim is carried out at a local area Z that has no rear wall, as can be seen in FIG. 11. Thus, the rear wall 73 may extend discontinuously along the curved trajectory of the receptacles 70, leaving one or several local area(s) Z to allow one or several lugs 47 to provide latching overlap on the second rim 30.

In that regard, such an embodiment with lug 47 also makes it possible to improve the packaging's resistance to stacking, and more particularly the performance of the lid of the lowest packaging in the stack: under the effect of the weight of the column, in the packaging of the state of the art the lid may become unlatched and literally collapse through the opening of the container. This embodiment, due to the latching of said at least one lug, allows better resistance to collapse. In such a case, at least one lug 47 and at least one foldable skirt section may be provided on each corner of the packaging.

According to the embodiment shown in FIG. 9, the foldable skirt section 44 bears said at least one lug 47, as well as the inward-directed rim 41, both positioned beneath the folding area 46, in the engagement position P1 of the foldable skirt section 44: the inward-directed rim 41 is therefore severed when the foldable skirt section 44 is raised from the engagement position P1 thereof. Alternatively, and as taught by document EP 2523866, the inward-directed rim 41 may be located above the folding area 46 so that the raising of the foldable skirt section does not sever the inward-directed rim 41, preserving the sealing properties of the lid with the first opening.

According to an illustrated embodiment, the container comprises four lateral walls meeting at four corners, the inward-directed rim 41 of the lid having four curved corner sections 43 with four foldable skirt sections 44, each bearing at least one lug 47 of the foldable skirt section, capable of latching with the second outward-directed rim 30 of the container. At least four lugs 47 provide a reliable latching of the lid at the four corners of the container, which further increases the latching connection between the lid and the container.

Figure 2:
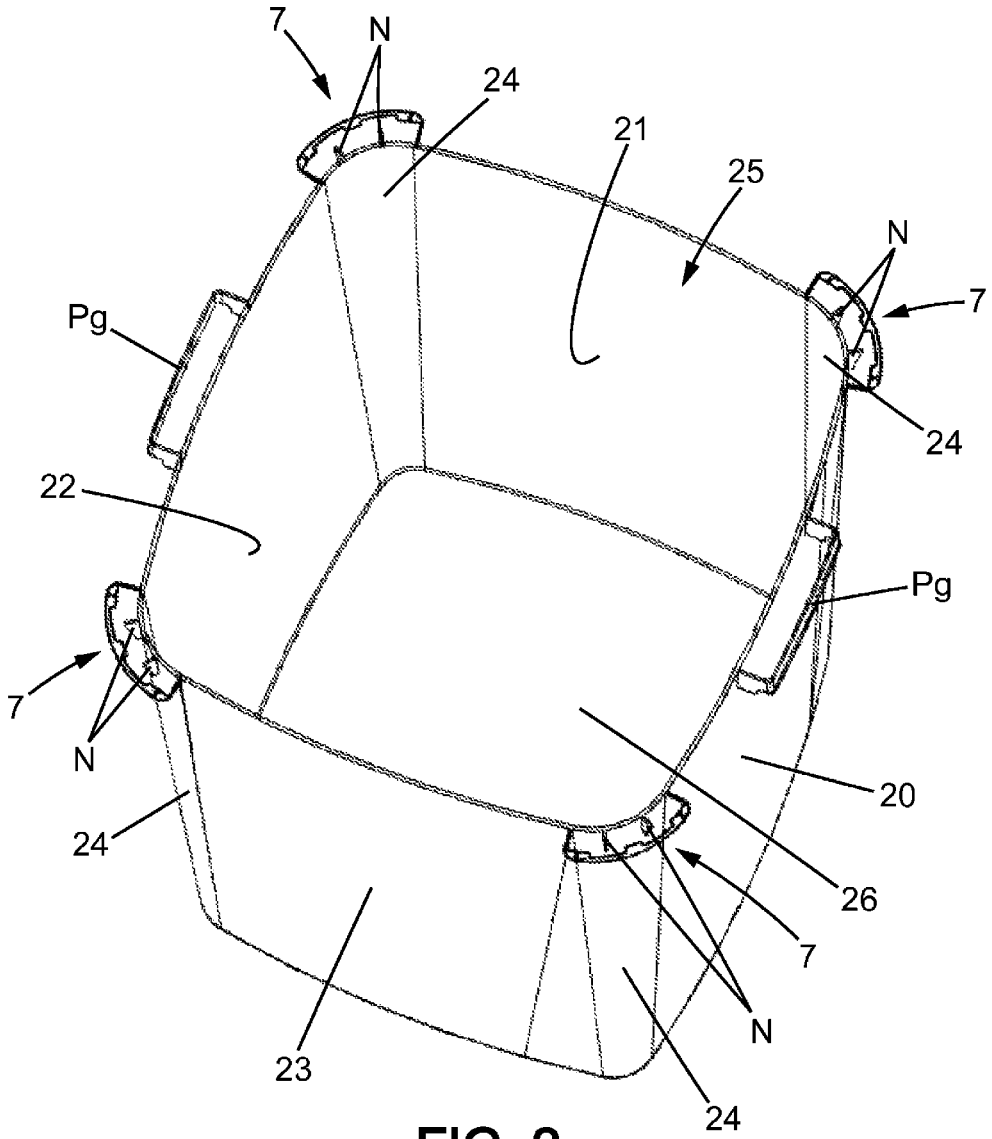
FIG. 2 is a section view along a substantially horizontal plane, parallel to the lid, passing at mid height of the four reception portions, at the four corners of the container, receiving the free ends of the four foldable skirt sections while forming for each of them a shield preventing an unintended lifting of the foldable skirt section.
Figure 3:
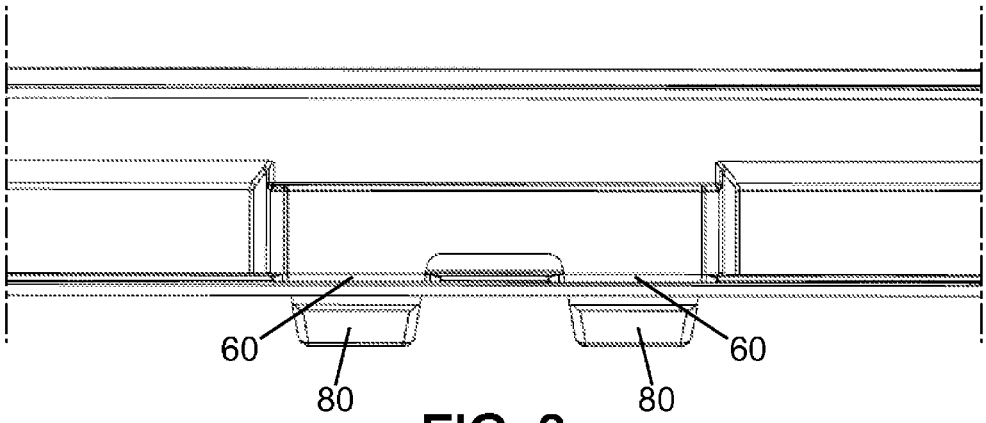
FIG. 3 is a detailed view of a snap-on system, in addition to the system of engagement between the outward-directed rim of the first engagement portion and the outward-directed rim of the second engagement portion, located on the lateral sections between the corners, and comprising openings borne by the first engagement portion and elastically deformable teeth, borne by the second engagement portion, engaged in the openings.

First of all, it will be noted in FIG. 2 that the latching can optionally be reinforced, again at the corners, with the presence of two lugs 47 on each foldable skirt section 44; at the curved corner sections. Doubling the lugs 47 per corners can be a general measure according to this embodiment.

Advantages and Disadvantages of the First Embodiment

The foldable skirt section or sections 44 are protected from inadvertent openings, each by a reception portion 7 the receptacle 70 of which traps the free end of the foldable skirt section, and for example over the full curved length of the free end EI.

It is only possible to fold each foldable skirt section 44 from its engagement position P1 (preventing removal of the lid) to the outward-directed position (facilitating the removal of the lid) after deformation of the reception portion 70, and particularly deformation of the front wall 71 in the retracted position PE where said front wall no longer constitutes an abutment hindering the folding of the foldable skirt section to the outward-directed position.

Advantageously, any accidental folding of the skirt section 44 is eliminated or at least drastically reduced, and thus the breakage of the grooves 45 between the foldable skirt section and the skirt 42, functioning as tamper-evident system: these grooves 45 cannot be broken accidentally.

The presence of the lugs 47, at least according to one embodiment, particularly at the four curved corner sections 43, first of all considerably improves the reliability of the tamper-evident system, requiring the user to break the grooves 45 to disengage the lugs 27 of the second rim 30.

The present disclosure also makes it possible to improve resistance to stacking of the packaging, and more particularly the performance of the lid of the lowest packaging in the stack under the effect of the weight of the column, when the skirt sections are provided with lugs 47.

Other Improvements

Also notably, in addition it will be noted that the peripheral wall 49 of the lid immediately extending the second engagement portion 40 may comprise, along edges of the lid on the lateral sections between the curved corner sections 43 where the inward-directed rim 41 of the lid latches the outward-directed rim 28 of the container, counter-support ribs 50, projecting, vertical, positioned beneath the lid, oriented outwards.

These counter-support ribs 50 are significant in that they advantageously form a plurality of counter-supports Ap on the inner faces of the lateral walls 20, 21, 22, 23 of the container, distributed around the periphery of the container on the lateral sections of the rims 28, 41 between the curved corner sections 43. These counter-supports Ap advantageously reinforce the latching between the rims 28, 41 along edges of the lid on the lateral sections of the rims 28, 41 between the curved corner sections 43.

Figure 5:
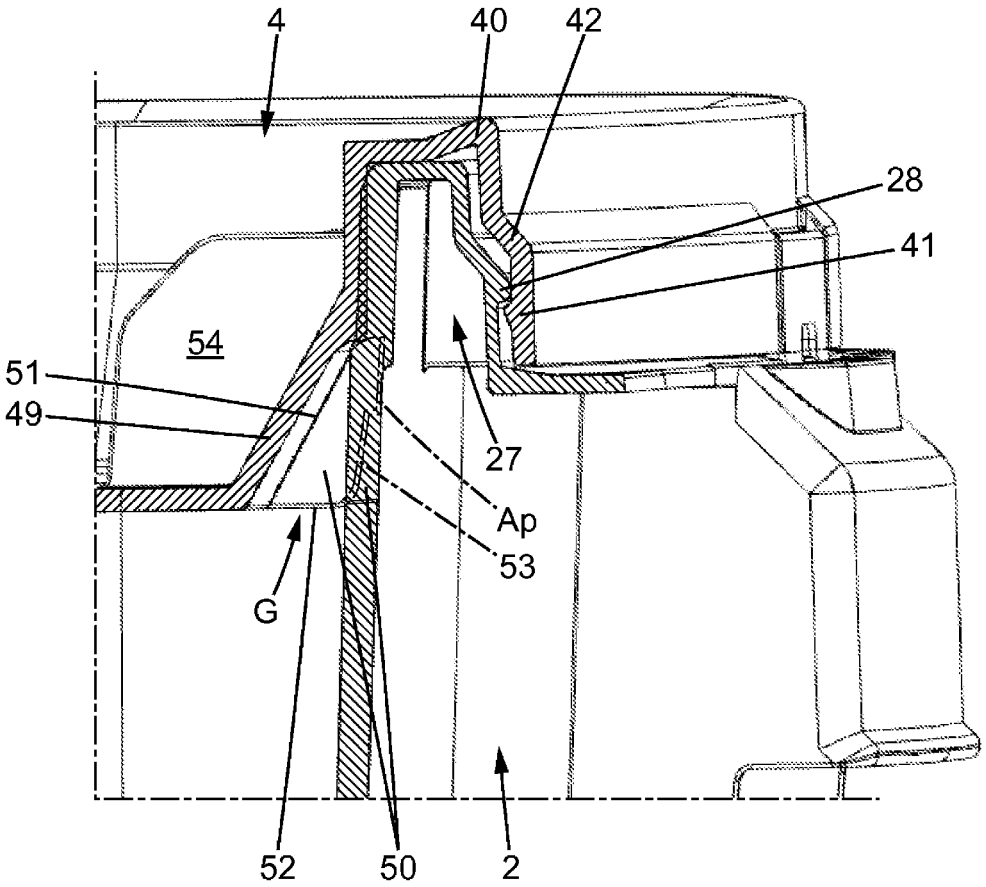
FIG. 5 is a section view along a cutting plane passing through the skirt section, illustrating the interlocking of the first engagement portion of the container onto the second engagement portion of the lid with cooperation of the inward-directed rib, latched beneath the outward-directed rib, and illustrating a snap-on system in the background; located in an intermediate position between the two corners, comprising elastically deformable teeth of the second engagement portion of the lid, projecting downward, received in the openings of a flange of the first engagement portion of the container, the flange bearing the openings of the first engagement portion of the container being extended downward by a wing forming a handle, projecting laterally from the lateral wall of the container

During stacking of a packaging on the lid of an identical packaging, advantageously, thanks to the combined presence of the lugs 47, on the foldable skirt sections 44, at the corners, on the one hand, and counter-support ribs 50, along the edges between the corners, on the other hand, a good holding of the latching is obtained of the lid on the container without disengaging the ribs 28, 41 over the full periphery of the lid, i.e., not only at the corners but also along the edges between the corners As can be seen in FIG. 5, the second engagement portion 40 forms a groove G open downward, receiving the first engagement portion 27. The second engagement portion 40 comprises an inverted U-shaped cross-section, including a first longitudinal section extending the upper wall of the lid (including immediately the peripheral wall 49 extended by a central horizontal wall of the lid), followed by a second longitudinal section, inclined relative to the first section, for example horizontal, followed by a third longitudinal section, inclined relative to the second section and extending downward forming a skirt 42, this third section bearing the inward-directed rim 41.

The peripheral wall 49 extends the second engagement portion 40 by connecting the second engagement portion to the horizontal wall of the lid. As can be seen in FIG. 5, this peripheral wall 49 can be inclined relative to the horizontal wall, the central one of the lid, for example by an angle a of between 30° and 70°, particularly between 45° and 70°. This wall 49 descends from the second engagement portion 40 toward the horizontal wall. This peripheral wall 49 defines with the lateral walls 20; 21; 22; 23, when the lid is attached to the container (by latching of ribs 28, 41) a groove G, opening below the under face of the lid 4 and which runs over the inner periphery of the container. It will also be noted that the counter-support ribs 50 extend into this groove G, in counter-support Ap on the inner face of the lateral wall 20; 21; 22; 23. These supports prevent the convergence of the peripheral wall 49 under load during stacking. Thus, advantageously such deformation is avoided, which tends to open the U-shaped section of the second engagement portion 40, promoting the detachment of the rims 28, 41 along the edges. A better maintenance of the latching is advantageously achieved between the rims 28 and 41 along the edges of the packaging between the corners.

The density of the counter-support ribs 50 along the edge of the lid 4, on the median part of the lateral section between two curved corner sections 43, may be greater than the linear density of the counter-support ribs 50 on the end parts of the lateral section in proximity to the curved corner sections 43, on either side of the median part.

Each counter-support rib 50 may be triangular in shape, adjoining the peripheral wall 49 by the largest side 51 of the triangle called first side, while a second side 52 of the triangle, substantially horizontal, is oriented in the extension of the horizontal wall of the lid and particularly at the under face thereof, the third side 53 forming a support area on the inner face of the container. It will also be noted that the third side 52 has a longer section, forming the counter-support Ap on the inner face of a lateral wall of the container, and a shorter section, reduced so as not to press on the lateral wall. The angle formed between the second side 52 and the third side 53 is advantageously rounded. Thus, the presence is avoided of a sharp angle likely to impair the contents, or even puncture a flexible pouch used to package the materials inside the container.

Figure 6:
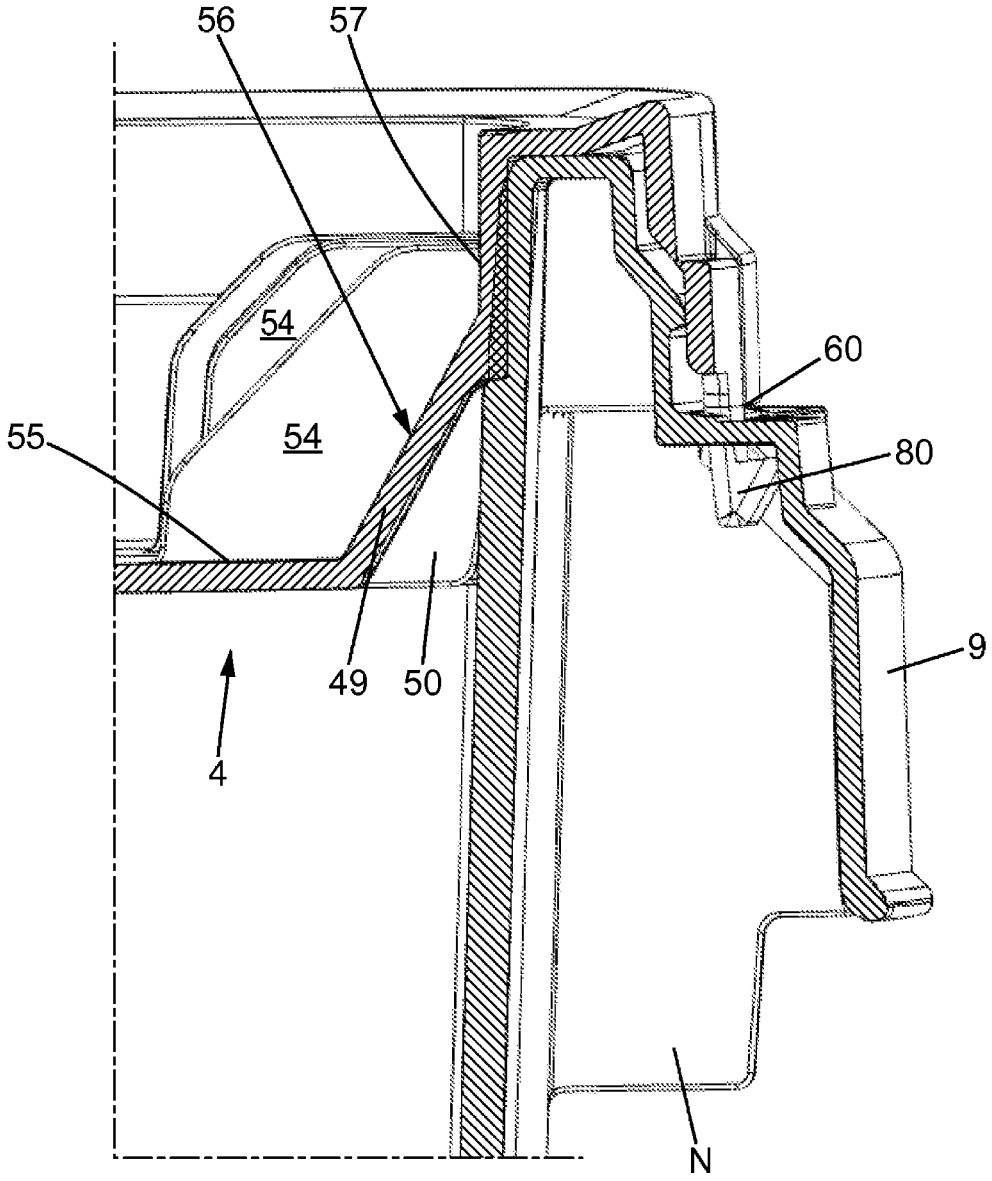
FIG. 6 is a section view along a substantially vertical plane passing through the snap-on system of FIG. 5 and the wing forming the handle, a reinforcing rib extending in connection between the lateral wall of the container and the handle forming wing, said rib extending downward and to a flat place, said rib constituting a rib serving a stacking pitch function, particularly in combination with vertical ribs extending below the first engagement portion, at the sections of curved corners

As can be seen in FIG. 6, the lid 4 can also comprise wedging ribs 54 extending in protrusion around the periphery of the lid, inwardly relative to the second engagement portion 40 and upward relative to the horizontal wall of the lid. The wedging ribs 54 are distributed over the inner periphery of the second engagement portion 40 so as to receive between them, while centering it, the lower part of a container of an identical packaging stacked on the horizontal wall of the lid. Said wedging ribs constitute abutments with the lower part of the lateral walls of the stacked container, ensuring the centering thereof on the lid.

The counter-support ribs 50 may be, at least in part, ribs situated, relative to the peripheral wall 49, in the extension of the wedging ribs 54; said counter-support ribs 50 and said wedging ribs 54 being coplanar by pairs.

Each wedging rib 54 extends upward from the horizontal wall of the lid to above the lower part of the second engagement portion 40, and inwardly, from the second engagement portion 40 to the horizontal wall, while partially overlapping the horizontal wall of the lid. As can be seen in FIG. 6 each wedging rib 54 is adjacent to the rest of the lid at a first rim 55 along the horizontal wall, at a second rim 56 along the inclined peripheral wall 49, and over part of the height of the second engagement portion along a third rim 57. In combination with the counter-support ribs 50, these wedging ribs 54 can participate in limiting the transmission of forces under load to the second engagement portion.

According to one embodiment, the first engagement portion 27 of the container is extended below the outward-directed rim 28 and the second engagement portion 40 is extended below the inward-directed rim 41, by mutually engaging first snap-on means 6 and the second snap-on means 8; at an intermediate local area along the edges of the container on the lateral sections between the curved corner sections.

The first snap-on means and the second snap-on means cooperate only in the intermediate area and reinforce the latching between the rims 28, 41. The first snap-on means 6 may comprise at least one opening 60, for example two openings, and the second snap-on means comprise an elastically deformable tooth 80 configured to be inserted elastically into said opening when latching it. The openings and the teeth may each be doubled, as illustrated.

Said means 6, 8 make it possible to reinforce the strength of the lid and its latching on the container by the rims 28, 41, particularly when the latter takes a large load, such as the load from a packaging supported on the lid. The resistance of the lid to the load increases particularly when the packaging are stacked on one another.

On two opposite lateral walls the flange bearing the openings 80 of the first engagement portion of the container is extended downward by a wing 9*f* forming a handle Pg, projecting laterally from the lateral wall of the container. These two handles Pg projecting laterally from two lateral walls of the container enable the packaging to be lifted.

It should also be noted that the container may have outer ribs N extending below the first engagement portion 27. Thus, these outer ribs N each extends vertically below the first engagement portion 27 of the container (bearing the outward-directed rim 21). Each outer rib N has, at the bottom end thereof, a flat part intended to cooperate in abutment with the upper edge of the top opening of the container inside which said container is stacked: The first function of such vertical outer ribs N is to ensure a constant stacking pitch between two containers when said containers are stacked one within the other as described in the Applicant's application FR 1854484

These ribs N may be provided in the corners, and extend vertically below each reception portion 7, at least to the height of the reception portion 7. Two ribs N may be provided below each reception portion. These ribs N may also be provided connecting wing 9 forming the handle Pg and the juxtaposed lateral wall 20 or 33

Figure 12:
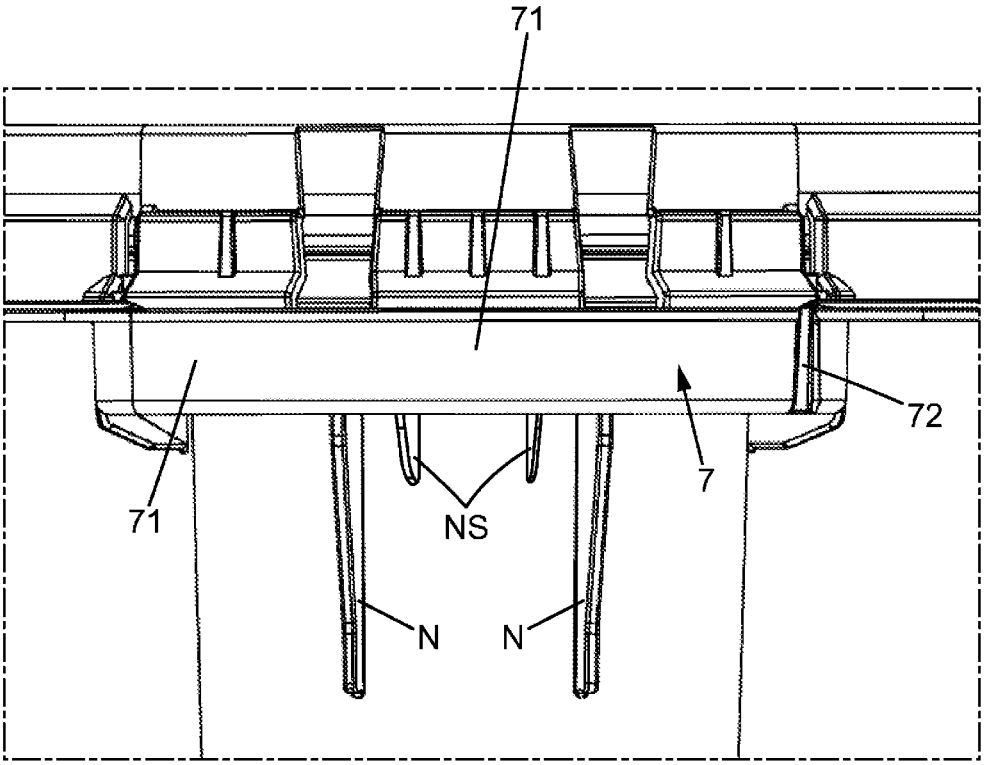
FIG. 12 is an alternative view of FIG. 7, with two additional ribs, extending with the stacking pitch ribs in the inter-space and the corner wall of the container and the reception portion, to form an obstacle to fraudulent unlatching of the lugs from the lower face (for example by inserting a finger, screwdriver, etc., in said inter-space).
Figure 13:
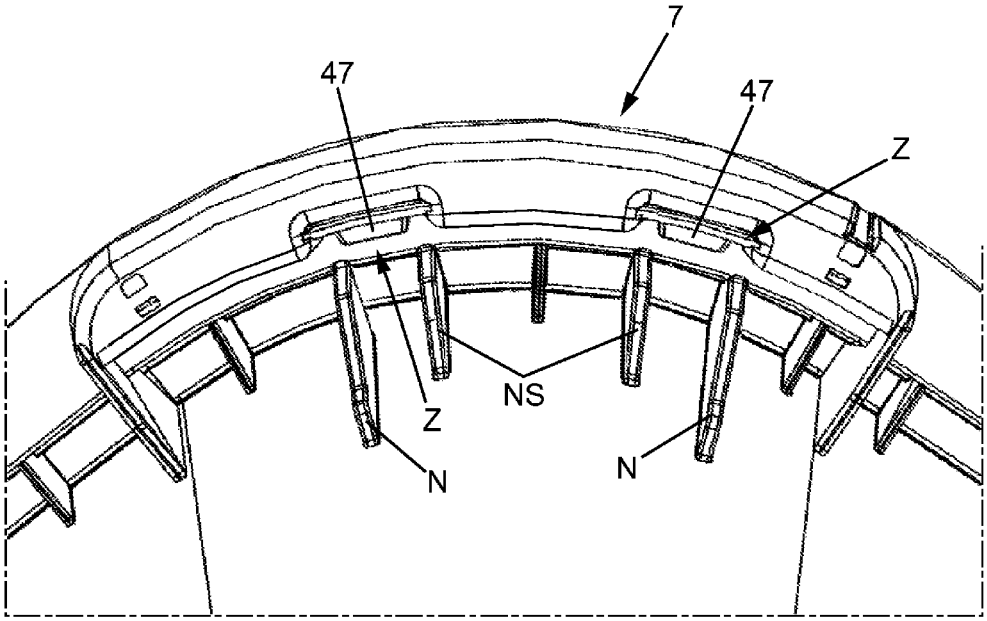
FIG. 13 is a bottom view of FIG. 12.

As can be seen in the figures, vertical ribs may advantageously be provided between the reception portion 7 and the corner wall perpendicular to areas Z with no rear wall: in particular, it may involve ribs N for stacking pitch, alone or in combination with additional ribs NS, particularly of smaller vertical dimensions, and as can be seen in FIGS. 12 and 13.

The position of these ribs particularly of the ribs N (alone or in combination with the additional ribs NS) makes it possible to prevent in the inter-space between the reception portion 7 and the corner wall, the fraudulent unlatching of the lugs 47 of the second rim 30 (i.e., without need for folding the skirt section 44, and the breakage of the grooves 45 serving as tamper evidence). The reliability of the tamper-evident system is increased.

Naturally, other embodiments of the invention may be considered without going beyond the scope of the invention as defined by the following claims.

List of Reference Signs

1. Packaging,
2. Container,
20, 21, 22, 23. Lateral walls,
24. Corners,
25. Top opening,
26. Bottom,
27. First engagement portion,
28. First outward-directed rim,
29. Curved corner section (ridge 28),
4. Lid,
40. Second engagement portion,
41. Inward-directed rim,
42. Skirt,
43. Curved corner section (rim 41),
44. Foldable skirt section,
45. Breakable grooves,
46. Folding area (for example flexible hinge),
47. Lug
48. Through-recess
49 Peripheral wall as extension of the second engagement portion 40
50 Counter-support ribs,
51. Large side of the triangle forming the counter-support rib,
52. Second side of the triangle in extension of the horizontal wall of the lid,
53. Third side of the triangle forming the counter-support rib,
54. Wedging ribs
55 First rim (Rib 54)
56 Second rim (Rib 54)
57 Third rim (Rib 54)
6, 8. First snap-on means and the second snap-on means,
60. Opening,
80. Teeth
7. Reception portion,
70. Receptacle,
71. Front wall,
72. Groove (front wall),
73. Rear wall
74. Bottom wall,
75. Material bridge,
9. wing
EI. Free end (foldable skirt section)
G. Groove
P1 Engagement position
PE. Retracted position
Rac1. Rac2 Latching overlaps
J. Clearance separating said lug and the second rim when no force is applied on the lid,
Pg. Handle
N. Outer ribs serving as stacking pitch
NS. Additional ribs
Z. Areas with no rear wall

The invention claimed is:

1. A packaging comprising a plastic container having lateral walls meeting at corners, a top opening and a bottom, and a removable plastic lid that is configured to cover the top opening of the container, and wherein the container is provided, at its top opening, with a first engagement portion bearing an outward-directed rim that extends around a periphery, the lid being provided, on a peripheral part, with a second engagement portion that is folded downward and has an inward-directed rim which is able to latch underneath the outward-directed rim of the container, and wherein the second engagement portion of the lid has a skirt extending over a lower part of the second engagement portion, and wherein the outward-directed rim of the container and the inward-directed rim of the lid having curved corner sections in the corners where said lateral walls meet, said curved corner sections connecting lateral sections of the outward directed rim and inward directed rims, where at least one of the curved corner sections of the inward-directed rim is provided with a foldable skirt section, articulated in a folding area at an upper part of the second engagement portion which is able to be folded from an engagement position to an outward-directed position in such a way that a central part of said at least one corner section of the inward-directed rim is separated by a levering effect of the outward-directed rim of the top opening, and that the engagement between the rims is thus weakened over the central part, wherein the container comprises, at the foldable skirt section of the lid, a reception portion forming a shield for a free end of the foldable skirt section, with a receptacle receiving said free end in the engagement position of the foldable skirt section, said reception portion being configured to prevent the folding of said foldable skirt section to said outward-directed position, and wherein said reception portion is configured to be deformed in order to release the free end and authorize the pivoting of the foldable skirt section from the engagement position to said outward-directed position.

2. The packaging according to claim 1, wherein the receptacle comprises a front wall, extending to overlap, in front of the free end of the foldable skirt section in the engagement position of the foldable skirt section, said front wall then constituting an abutment preventing the folding of said foldable skirt section to said outward-directed position, and wherein said front wall is configured to be deformed by an operator to a retracted position enabling the free end to be released and authorizing the pivoting of the foldable skirt section around the folding area from the engagement position to the outward-directed position.

3. The packaging according to claim 2, wherein the front wall is secured at longitudinal ends by material bridges in the form of vertical ribs connecting respectively the longitudinal ends of the front wall and the lateral walls or corner walls of the container, and wherein a groove reducing the thickness of the front wall is provided at one of the longitudinal ends of the front wall, configured in such a way as to break by dissociating a longitudinal end of the material bridge when the front wall is deformed to the retracted position.

4. The packaging according to claim 3, wherein the front wall deformed after breakage of the groove to the retracted position and authorizing the folding of the skirt section to the outward-directed position, is still adjoining the container via the other longitudinal end.

5. The packaging according to claim 2, wherein the engagement portion of the container bearing the outward-directed rim extends and is elongated below the rim, named first rim, and is terminated below the first rim by an outward directed second rim, and wherein the receptacle receiving the free end of the foldable section comprises a rear wall of which an upper end is integral with said second rim, the back being integral with the front wall via a bottom wall connecting the lower end of the rear wall and the lower end of the front wall the section comprising the front wall, the rear wall and the bottom wall forming a U-shaped section of the receptacle receiving the free end of the foldable skirt section.

6. The packaging according to claim 5, wherein the foldable skirt section bears at least one inward-directed lug, which, in the engagement position of the foldable skirt section, is able to latch beneath the second outward-directed rim of the first engagement portion, at least when a force is applied on the lid tending to detach it, and wherein the latching of said at least one lug on the second rim is produced, in the engagement position of the foldable skirt section in a local area only along the curved corner section of the second outward-directed rim, and with a latching overlap between mutually engaging faces of said at least one lug and of the second rim, when viewed in a direction radial to the curved section of the second rim, of larger dimension than the latching overlap between mutually engaging faces of the inward-directed rim and of the first outward-directed rim, when viewed along a direction radial to the curved section of the first rim.

7. The packaging according to claim 5, wherein latching of said at least one lug beneath the second rim is produced in a local area with no rear wall.

8. The packaging according to claim 6, wherein the foldable skirt section of the lid having a through-recess extending along a height of the foldable skirt section, above and perpendicular to said at least one lug.

9. The packaging according to claim 8, wherein said through-recess extends from a lower part thereof from said at least one lug and up to the folding area between the foldable skirt section and the upper part of the second engagement portion, and only over the length of the lug.

10. The packaging according to claim 6, wherein in the engagement position of the foldable skirt section, and when no exterior force is applied to the lid, the latch between the inward-directed rim and the first outward-directed rim is free, while a clearance separates the second outward-directed rim and said at least one lug positioned below the second rim, said lug coming into latching contact with the second rim only when the lid is subjected to a force.

11. The packaging according to claim 1, wherein the free end of the foldable skirt section has a curved profile, along a plane parallel to the lid, and wherein the receptacle of the reception portion has, in length, a curved trajectory receiving the curved profile of the free end.

12. The packaging according to claim 1, wherein said foldable skirt section is separated from the remaining skirt section by means of two grooves formed in an external surface of the skirt and extending downward from a folding area to a lower edge of the skirt, said grooves reducing the wall thickness of the skirt such that the skirt can be broken along the grooves in order to fold the foldable skirt section, from the engagement position thereof, into the outward-directed position thereof.

13. The packaging according to claim 1, the container of which comprises four lateral walls meeting at four corners, the inward-directed rim of the lid having four curved corner sections with four foldable skirt sections, and four reception portions receiving respectively the free ends of the four foldable skirt sections.

14. The packaging according to claim 1, wherein the foldable skirt section bears said at least one lug, as well as the inward-directed rim, both positioned under the folding area, in the engagement position of the foldable skirt section.

15. The packaging according to claim 1, wherein the first engagement portion of the container is extended below the outward-directed rim by first snap-on means and the second engagement portion is extended below the inward-directed rim, by second snap-on means, the first snap-on means and said second snap-on means being mutually engaging in an intermediate local area along edges of the container on lateral sections between the curved corner sections where the inward-directed rim of the lid latches the outward-directed rim of the container.

16. The packaging according to claim 15, wherein the first snap-on means comprise at least one opening, and the second snap-on means comprise an elastically deformable tooth configured to be elastically inserted into said opening by latching it.

17. The packaging according to claim 1, wherein a peripheral wall of the lid immediately extending the second engagement portion comprises, along the edges of the lid, on lateral sections between the curved corner sections where the inward-directed rim of the lid latches the outward-directed rim of the container, counter-support ribs, projecting, vertical, positioned under the lid, oriented outwardly, forming between the curved corner sections a plurality of counter-supports on the inner faces of the lateral walls of the container, distributed around the periphery of the container, reinforcing the latching between the rims latched along the edges of the lid between the curved corner sections.

18. The packaging according to claim 1, comprising wedging ribs, extending in projection around the periphery of the lid, toward the interior relative to the second engagement portion and upward relative to a horizontal wall of the lid, said wedging ribs being distributed around an inner periphery of the second engagement portion, in such a way as to receive among them a lower part of a container, while centering it, of an identical packaging stacked on the horizontal wall of the lid, said wedging ribs constituting abutments with a lower part of the lateral walls of the stacked container.

19. The packaging according to claim 1, having outer ribs each extending vertically below the first engagement portion, each rib having at its lower end a flat place intended to cooperate in abutment with an upper edge of the top opening of the container inside which the container is stacked, the outer ribs being provided at least partially in the corners, extending vertically below each reception portion at least up to the height of the reception portion.

20. A method for manufacturing a packaging according to claim 1, wherein said lid and said container are obtained by injection molding.

* * * * *